United States Patent [19]

Brusasca et al.

[11] Patent Number: 4,599,960

[45] Date of Patent: Jul. 15, 1986

[54] SEWING MACHINE THREAD CHAIN CUTTER

[75] Inventors: Gianfranco Brusasca, Milan; Franco Garzulano, Novara, both of Italy

[73] Assignee: Rockwell-Rimoldi S.p.A., Italy

[21] Appl. No.: 725,072

[22] Filed: Apr. 19, 1985

[30] Foreign Application Priority Data

Nov. 9, 1984 [IT] Italy ..... 23740/84[U]

[51] Int. Cl.[4] ..... D05B 65/06

[52] U.S. Cl. ..... 112/287; 112/DIG. 1; 83/98

[58] Field of Search ..... 112/287, DIG. 1, 288; 83/98, 99, 100

[56] References Cited

U.S. PATENT DOCUMENTS

| | | | |
|---|---|---|---|
| 3,143,987 | 8/1964 | Daniel et al. | 112/287 |
| 3,749,040 | 7/1973 | Jurgens | 112/287 |
| 4,328,758 | 5/1982 | Souza et al. | 112/287 X |

FOREIGN PATENT DOCUMENTS

| | | | |
|---|---|---|---|
| 2059463 | 4/1981 | United Kingdom | 112/287 |

*Primary Examiner*—Werner H. Schroeder
*Assistant Examiner*—Andrew M. Falik

[57] ABSTRACT

A thread-cutting device for a sewing machine comprises a rigid casing fixed on one edge of the working surface of the sewing machine in a position adjacent to the fabric being sewn. A discharge tube extends from one end of the casing to a suction mouth located on the other end of the casing and faces the fabric being sewn. A blower apparatus is supplied with compressed air and comprises at least one vent located in the mouth and is designed to direct the compressed air along the discharge tube. A pivotable cutting element is mounted in the region of the suction mouth. A control element is fixed to the casing and has a rod shaped portion passing across the suction mouth which can be positioned in a plurality of reference notches located on the outside of the casing. The reference notches are arranged in accordance with the types of fabric to be sewn and are designed to position the rod-shaped portion in a direction substantially perpendicular to the feed direction of the fabric being sewn.

4 Claims, 3 Drawing Figures

SEWING MACHINE THREAD CHAIN CUTTER

The present invention relates to a thread-cutting device for a sewing machine, for example for a sewing machine which forms a whipstitch on the edges of a fabric.

BACKGROUND OF THE INVENTION

As is known, sewing machines of the industrial type are provided with various auxiliary devices, the function of which is to make the sewing operations as complete and precise as possible, thereby also reducing the need for manual intervention by the operators controlling the sewing operations. Of these auxiliary devices, a particularly important role is played by the thread-cutting devices, the specific function of which is to cut off the thread chain, or loose portion of thread, which is formed on a fabric, at the ends of a seam, when the sewing machine continues to operate in the absence of fabric.

These devices suck in the free thread-chains by means of jets of compressed air. These jets can either strike the thread chains directly, so as to turn them back on the fabric and cause them to mesh with the seam, or may be directed, as is usual, so as to create a suction effect which draws the thread chains into a suitable suction mouth in the region of which a cutting element is arranged. The present-day thread-cutting devices perform the operations for which they are intended in an only partially satisfactory manner. In fact, calibrating the size of the suction mouth through which the thread chains are sucked still represents a delicate operation which is often inaccurately performed.

This suction mouth must in fact be relatively wide and located in the immediate vicinity of the edge of the fabrics being sewn, so as to ensure that the thread chains are sucked in. In this situation, however, it can easily happen that the fabric being sewn can accidentally enter the suction mouth and suffer extensive damage as a result.

Therefore, the operators controlling the sewing operations must carefully monitor the actual sewing and arrange the thread-cutting device so as to prevent, as far as possible, the fabrics being sucked in.

However, as is obvious, this gives rise, on the one hand, to the need to use an expert labor force and, on the other hand, to the acceptance of a large number of inaccuracies, during the sewing process, on account of incorrect calibration of the thread-cutting devices.

It is important to underline the fact that not all fabrics behave in the same manner with regard to the thread-cutting devices: the stiffer and heavier fabrics are substantially stable and are unlikely to enter the suction mouth of the thread-cutting devices, whereas the lighter fabrics are more likely to enter the latter.

The thread chains are also likely to enter into the suction mouth to a greater or lesser extent, depending on the thickness of the thread with which they are made.

Since this thread usually has a cross-section which is proportional to the thickness of the fabric being sewn, it follows that the thread chains present on stiffer fabrics require particularly large suction mouths, to ensure that they are sucked in, whereas the thread chains extending from lighter fabrics are sucked in even by smaller-sized mouths. It is obvious that a thread-cutting device intended for heavy fabrics will suck inside it not only the thread chain of lightweight fabrics, but also the lightweight fabrics themselves. On the other hand, a thread-cutting device designed for lightweight fabrics will prove to be ineffective for heavy fabrics. In view of this situation, the general object of the present invention is to design a thread-cutting device for a sewing machine, which is able to overcome the abovementioned drawbacks of the prior art.

SUMMARY OF THE INVENTION

Within the scope of this general object, an important object of the present invention is to design a device which, while it can be easily adapted and set according to the fabrics being sewn, also has an extremely simple structure and can be easily produced by the industries in the sector.

Another important object of the present invention is to design a device which can be easily adjusted, even by unskilled personnel.

These and other objects which will become more apparent below are achieved by a thread-cutting device for a sewing machine, of the type comprising: a rigid casing fixed on one edge of the working surface in a position adjacent to the fabric being sewn, a discharge tube extending from one end of the said casing to a suction mouth located on the latter and facing the said fabric, a blower apparatus supplied with compressed air and comprising at least one vent located in the said suction mouth and designed to direct the compressed air along the said discharge tube, and a cutting element which is able to swing to and fro and is arranged in the region of in the said mouth, wherein the said metal casing has fixed to it a control element which is provided with a rod-shaped portion passing across the said mouth and can be positioned in a plurality of reference notches located on the outside of the said casing, the said reference notches being arranged in accordance with the types of fabric which can be sewn and being designed to position the said rod-shaped portion in a direction substantially perpendicular to the feed direction of the fabric being sewn.

DESCRIPTION OF THE DRAWINGS

Further characteristic features and advantages will become clearer from the detailed description of a preferred embodiment of the invention, illustrated by way of example in the attached drawings in which.

DESCRIPTION OF THE INVENTION

With reference to the abovementioned figures, the thread-cutting device which is the subject of the present invention is indicated by the number 1. It is applied to a sewing machine 2 known per se.

Figure 1:
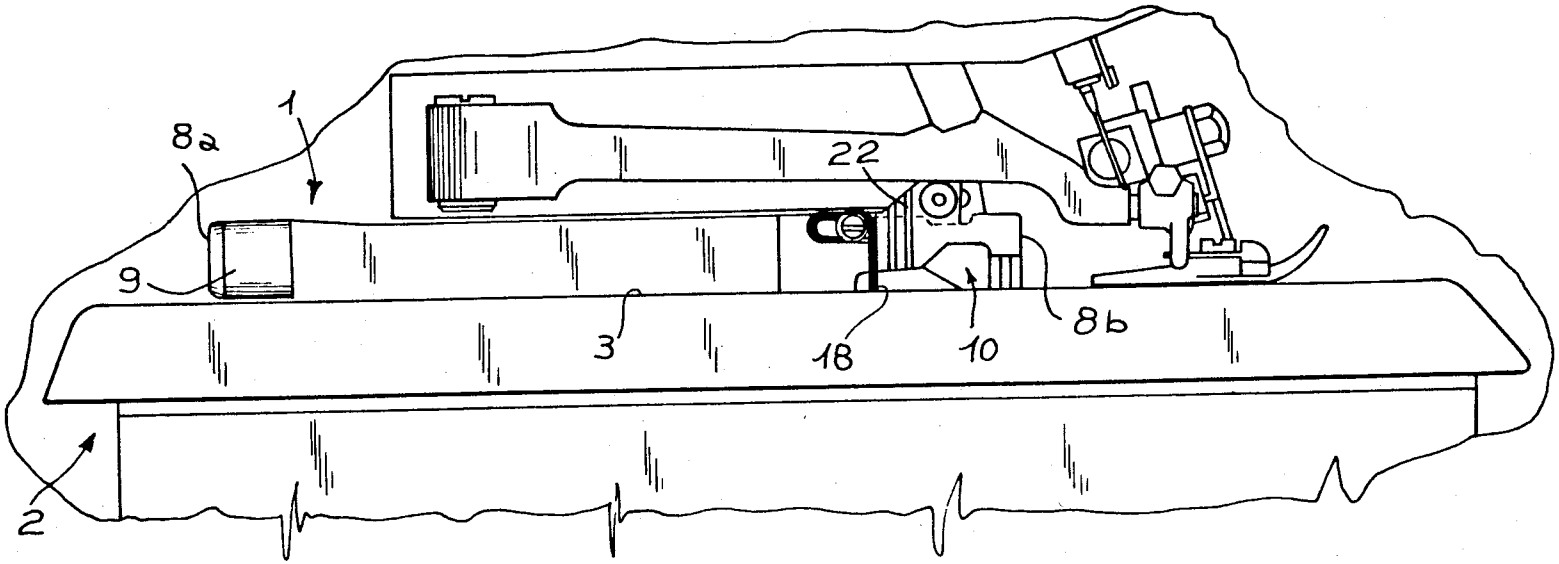
FIG. 1 is a side view of a sewing machine provided with the thread-cutting device according to the invention, elevated from the working surface of the sewing machine itself.
Figure 2:
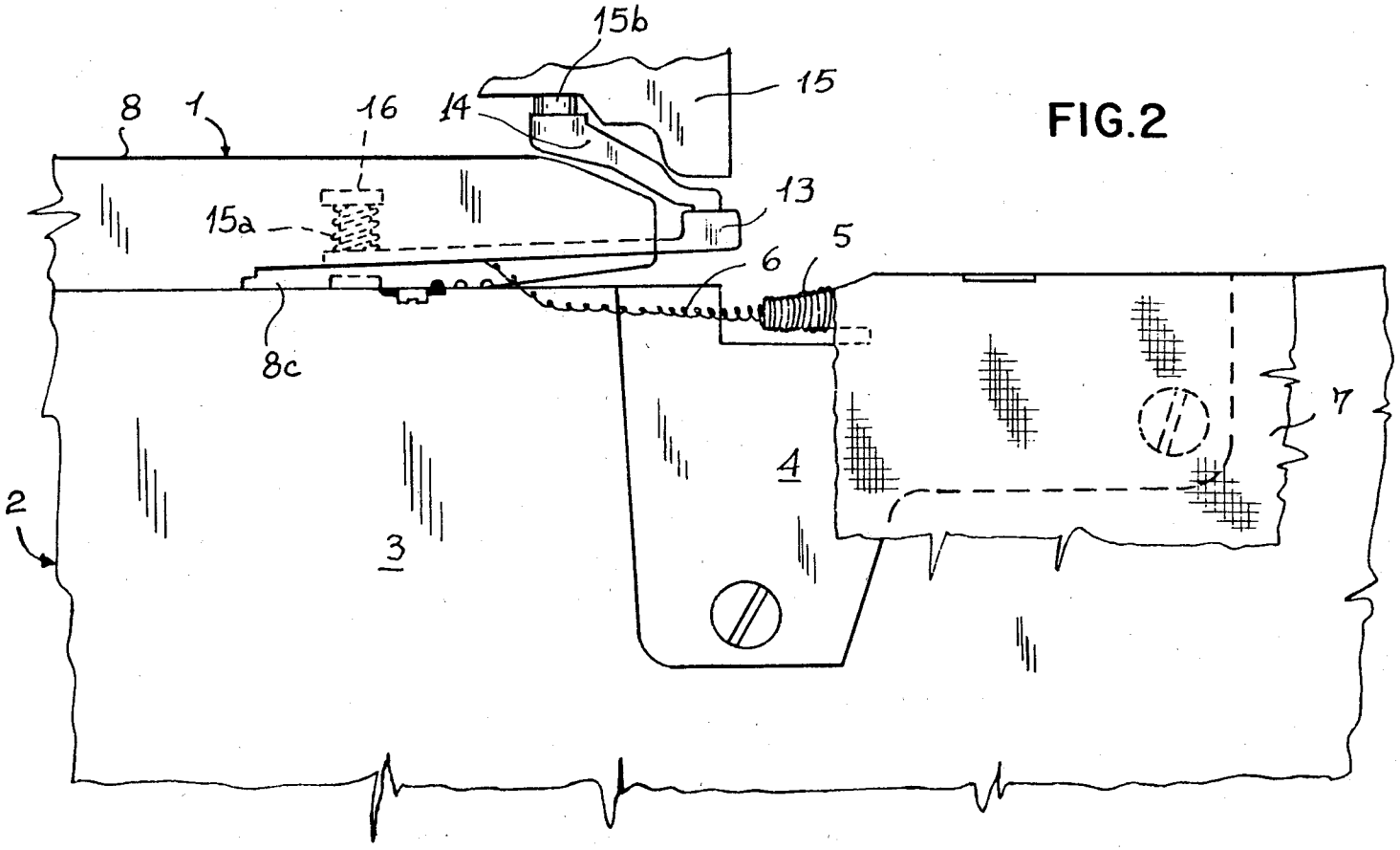
FIG. 2 is a plan view, on an enlarged scale, of part of FIG. 1 in which the needle plate and thread-cutting device are shown.

In detail, as shown in FIGS. 1 and 2, the device 1 is applied to one edge of a working surface 3 of the sewing machine 2, behind a needle plate 4.

The needle plate 4 has, in a manner known per se, a tongue 5 around which a thread chain 6 is initially formed and which produces a first external part of a seam on a fabric 7 (FIG. 2).

The fabric 7 is moved forward in the direction of the thread-cutting device 1 by means of teeth located in the needle plate 4.

Further elements of the sewing machine 2 are not shown since they are known per se and, in any case, are not relevant for the purposes of the present invention.

Figure 3:
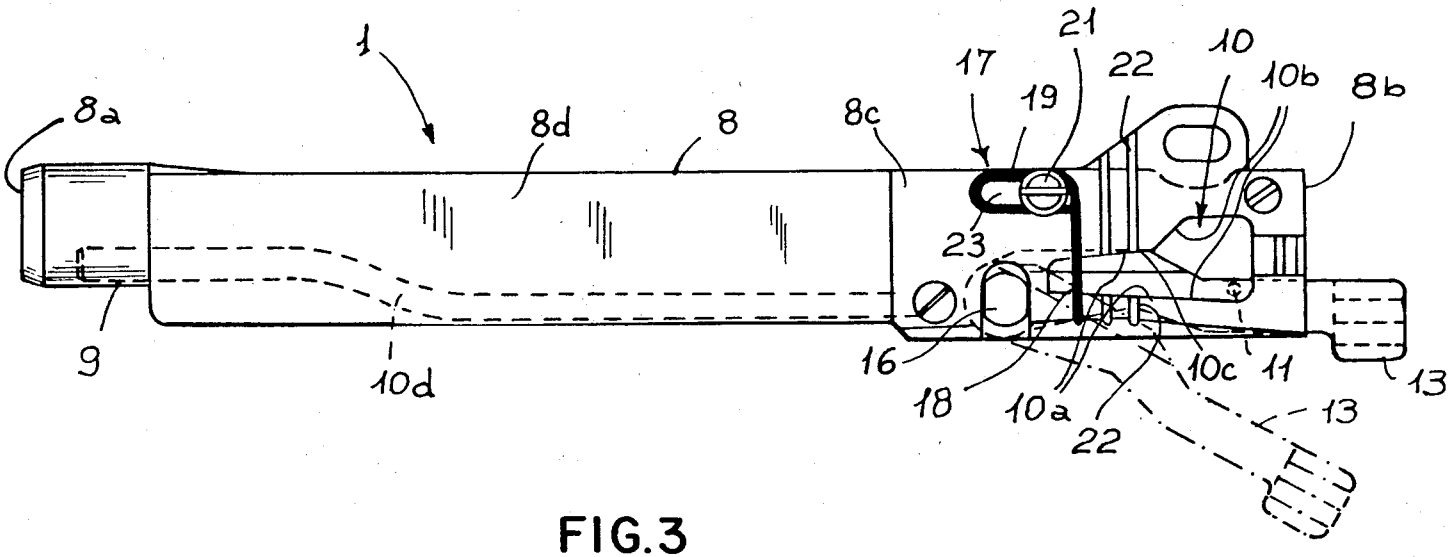
FIG. 3 shows, in isolation, the thread-cutting device, with the closed position of the cutting element being indicated by continuous lines and the open position by dot-dash lines.

The thread-cutting device 1 is shown in isolation in FIG. 3 and is externally defined by a rigid, metallic-type casing 8 which has inside it a discharge tube 9 extending from one end 8*a* of the casing 8 to a suction mouth 10 located in the casing 8 and positioned in parallel relationship with the working surface 3, in a position such that it lies alongside the fabric 7 being sewn, when the latter moves beyond the needle plate 4. Looking at the figures of the accompanying drawings it is possible to see that suction mouth 10 is formed in plate 8*c* which completes the vertical wall 8*d* of casing 8. Plate 8*c* faces the needle plate 4 in the region of the front end 8*b* of the casing.

More particularly, plate 8*c* is disposed in such a way that it is lightly touched by the overedge stitches of the fabric 7.

The thread 6 is drawn into the thread chain cutter by virtue of the Venturi effect. In this way, the vacuum is created by the compressed air within the discharge tube in the zone immediately behind suction mouth 10. This vacuum is capable of attracting all of the small and light weight bodies that pass close to the suction mouth, as well as thread chain 6, which is attached to the leading and the trailing edges of the fabric. A blower apparatus supplied with compressed air from any known type of air compressor (not shown) communicates with the suction mouth 10 via an appropriate pipe 10*d*. The said blower apparatus may be structured in various ways, but ends, in any case, in a vent 11 for the compressed air, located at one end of the suction mouth 10, in particular at the end of the latter located furthest away from the end 8*a* of the casing 8.

The vent hole 11 is oriented towards the end 8*a* of the casing 8 in such a way that it generates a vacuum in the zone lying behind the suction mouth 10. The second vent 12 is directed towards the incoming fabric 7 still located on the needle plate 4. The vent 11 is directed to the opposite direction with respect to the second vent 12; that is said vent 11 supplies an air jet along the discharge tube 9 towards the end 8*a* of the casing 8.

The suction mouth 10 also comprises a cutting element 13, consisting of a blade which is oscillated by means of a crank 14 (FIG. 2) which is in turn actuated by a control shaft 15*b* mounted within the frame 15 of the machine and operatively connected to the main shaft of the latter.

The cutting element 13 is designed to operate, swinging angularly upwards, when the fabric 7 is in a rest phase, i.e. between two feed operations performed by the said teeth.

The suction mouth 10 comprises a first zone shaped in the manner of a slot 10*a* extending substantially in a horizontal direction and parallelly to the direction in which fabric 7 being shown is fed.

Suction mouth 10 is completed by a second zone shaped as a wide opening 10*b* which widens out, starting from the lower edge of slot 10*a*, toward the front end 8*b* of casing 8 and an upward direction so that it extends higher than the upper edge of the slot forming a cutting edge 10*c*, which edge cooperates with movable blade 13 for cutting the thread chain 6.

The thread chain 6 is cut in the first zone 10*a* by means of the cutting element 13 and a cutting edge 10*c* located in the same zone 10*a*.

The cutting element 13 is kept in close contact with the said cutting edge by means of a compression spring 20 wound around a pin 16 which defines the axis of rotation of the cutting element 13 (FIG. 2).

Advantageously, provision is made for a control element 17 to be arranged on the outside of the casing 8, which element has a rod-shaped portion 18 which passes across the suction mouth 10 in a direction perpendicular to the direction in which the latter mainly extends.

The rod-shaped portion 18 can be positioned across the suction mouth 10 towards or away from the second end 8*b* of the casing 8.

In practice, the control element 17 consists of a spring wire 19 provided, at the top, with an eyelet 23 substantially parallel to the direction in which the fabric 7 is fed. The eyelet 23 is fixed to the casing 8 by means of a screw-type connecting element 21.

The rod-shaped portion 18 is a simple extension of the spring wire 19 and extends from one end of the eyelet 20 in a direction perpendicular to the latter.

Reference notches 22, located on the outside of the casing 8, are advantageously provided for positioning of the rod-shaped portion 18.

The notches 22 are advantageously grooves which are provided on the casing 8 and are designed to accommodate substantially the rod-shaped portion 18.

The notches 22 themselves extend in the region of both the edges of the suction mouth 10 which are parallel to the direction in which the fabric is fed.

In the example shown three notches 22 are provided, but it is obvious that there can be any number of notches.

Of the three notches shown, the notch closest to the end 8*a* of the casing 8 and delimiting a smaller part of the area 10*a* of the mouth 10 is the first notch provided for positioning the rod-shaped portion 18 in the case of heavy fabrics such as denim or interlock knitted fabrics.

The middle notch or second notch is provided for average-weight fabrics such as knitted fabric up to fineness level 7, or for fabrics made using textured-polyester yarns.

Finally, the notch closest to the second end 8*b* of the casing 8, or third notch, is provided for lightweight fabrics such as knitted fabric, rib fabric (30 denier) or non-run fabric (90 denier).

Operation of the thread-cutting device is as described below. As shown in FIG. 2, the thread chain 6 is formed on the projecting part 5 of the needle plate 4 when the fabric is not yet on the projecting part itself.

As the fabric itself is fed towards the thread-cutting device 1, the thread chain 6 is removed from the tongue 5 and remains hanging so that, as the fabric 7 moves towards the thread-cutting device 1, it is sucked inside owing to the suction effect generated by the jet of compressed air emerging from the vent 11 in the direction of the discharge tube 9.

The vent hole 11 is located on the inner wall of the discharge tube 9, which wall is opposite the suction mouth 10 and said vent hole 11 is oriented so that it directs the stream of compressed air towards the rear end 8*a*. In addition, said vent hole 11 is disposed backwardly, towards the front end 8*b* so that between the vent hole itself and the suction mouth 10 a thread chain suction chamber is created within the discharge tube 9.

The compressed air, that can be produced by any known generator (not shown) is sent into the pipe 10*d* and allowed to come out of the vent hole 11 within the discharge tube 9.

The stream of compressed air coming out of the vent hole 11 expands quickly as far as it takes up the whole discharge tube 9 starting from a point thereof which is situated downstream of the suction mouth 10, in the direction of the rear end 8*a* of said discharge tube 9.

Thus the expansion of the compressed air generates the Venturi effect in the thread chain suction chamber, namely it generates a vacuum such that the environmental air which is close to the suction mouth 10 is sucked into said chamber. And together with said air, the thread chain 6 is also drawn into the discharge tube 9 through said suction mouth 10.

After the thread chain 6 has been sucked in and subsequently cut by the cutting mechanism, said thread chain is urged by the stream of compressed air along the discharge tube 9 towards a collecting means (not shown) operatively connected to the rear end 8*a*.

The working zone for insertion of the thread chain 6 that is delimited, on one side, by the rod-shaped portion 18 and, on the opposite side, by the end of the suction mouth 10 closest to said front end 8*b* of the casing 8.

Once the thread chain 6 is inserted, it is subjected to the action of the cutting element 13 which shortens the said thread chain all the more, the closer the point of attachment of the thread chain itself is located to the rod-shaped portion 18.

Where lightweight fabrics are being sewn, the yarn forming the thread chain 6 will also be very light and therefore the space delimited by the third notch 22 will be perfectly adequate for insertion of the thread chain itself. At the same time, the advanced position of the rod-shaped portion 18 prevents the lightweight fabric being sucked accidentally into the suction mouth.

In the case of heavy fabrics, the rod-shaped portion 18 is arranged in the first notch and, therefore, the working zone of the suction mouth is increased so as to ensure insertion of a thread chain normally consisting of yarn which has a larger cross-section and is hence stiffer. The widening of the suction mouth does not lead to the fabric being accidentally sucked in during sewing, on account of the stiffness of the said fabric.

Substantially similar considerations apply in the case of average-weight fabrics.

The rod-shaped portion 18 can be easily and accurately positioned owing solely to the presence of the notches 22, together with the appropriate instructions. Moreover, the notches 22 allow the rod-shaped portion 18 to be inserted flush with the casing 8. The rod-shaped portion 18 is thus prevented from hindering or blocking the fabric which is being fed forward in the vicinity of the suction mouth 10.

The invention thus achieves the proposed objects.

Practical tests have shown that even unskilled personnel are able to arrange the rod-shaped portion 18 in the correct position immediately, thereby eliminating most of the down-time resulting from test operations and manufacturing rejects. This reliability and ease of use is advantageously obtained by means which are very simple and can be manufactured without difficulty.

All of the detailed features can be replaced by technically equivalent elements. In practice, the dimensions may be of any magnitude and the materials of any kind, according to requirements.

We claim:

1. A thread-cutting device for a sewing machine, of the type comprising: a rigid casing fixed on one edge of the working surface of the sewing machine in a position adjacent to the fabric being sewn, a discharge tube extending from one end of said casing to a suction mouth located on the other end of said casing and facing the fabric being sewn, a compressed air feed pipe, comprising at least one vent located in the said mouth and designed to direct said compressed air along the said discharge tube, and a pivotable cutting element mounted in the region of the said suction mouth, said casing having a control element fixed to it which is provided with a rod-shaped portion passing across the said suction mouth and means for positioning said rod-shaped portion in a plurality of reference notches located on the outside of the said casing, the said reference notches being arranged in accordance with the types of fabric which can be sewn and being designed to position the said rod-shaped portion in a direction substantially perpendicular to the feed direction of the fabric being sewn.

2. A device as claimed in claim 1, wherein the said notches are grooves provided on the said casing and designed to accommodate substantially the said rod-shaped portion.

3. A device as claimed in claim 1, wherein the said control element consists of a spring wire provided with an eyelet arranged substantially parallel to the direction in which the said fabric is fed and fixed to the said casing by means of a screw-type connecting element, and wherein the said rod-shaped portion is an extension of the spring wire.

4. A device as claimed in claim 1, wherein the said notches are provided on both the edges of the said suction mouth which are substantially parallel to the direction in which the fabric is fed.

* * * * *